United States Patent [19]

Raudat

[11] Patent Number: 4,570,413

[45] Date of Patent: Feb. 18, 1986

[54] CASE PACKER WITH LOAD DECELERATING AND IMPACT ABSORBING MEANS

[75] Inventor: John L. Raudat, North Madison, Conn.

[73] Assignee: Standard-Knapp, Inc., Portland, Conn.

[21] Appl. No.: 611,336

[22] Filed: May 17, 1984

[51] Int. Cl.[4] ..... B65B 21/02; B65B 39/02

[52] U.S. Cl. ..... 53/247; 53/248; 53/250; 53/260

[58] Field of Search ..... 53/246, 247, 248, 250, 53/260, 261, 262, 539

[56] References Cited

U.S. PATENT DOCUMENTS

| | | | |
|---|---|---|---|
| 2,957,287 | 10/1960 | Cella | 53/250 |
| 3,691,717 | 9/1972 | Pirro | 53/248 |
| 4,003,185 | 1/1977 | Goff | 53/248 |
| 4,261,158 | 4/1981 | Van Kattenbroek | 53/248 |
| 4,325,208 | 4/1982 | Barker | 53/248 |

FOREIGN PATENT DOCUMENTS

| | | | |
|---|---|---|---|
| 155031 | 4/1952 | Australia | 53/539 |
| 440307 | 2/1975 | U.S.S.R. | 53/248 |

*Primary Examiner*—Robert L. Spruill
*Assistant Examiner*—Michael D. Folkerts
*Attorney, Agent, or Firm*—McCormick, Paulding & Huber

[57] ABSTRACT

A drop packer has a conventional shifting grid, with a funnel structure to guide the dropped articles into a packing case provided therebelow. The case is lifted to mate with funnel and has a resiliently biased platform to absorb the impact of the articles dropped into the case. The grid has control arms to lower each article at a controlled rate for at least an initial portion of its descent.

5 Claims, 6 Drawing Figures

CASE PACKER WITH LOAD DECELERATING AND IMPACT ABSORBING MEANS

BACKGROUND OF THE INVENTION

This invention relates generally to case packers of the type having a grid with shifting riding strips, into which grid charges of articles are received in an upper portion of the grid for gravity feed into upwardly open packing cases moved sequentially to a loading station below the grid.

FIELD OF THE INVENTION

More particularly, this invention deals with a shifting grid that may include a funnel subassembly in the form of finger clusters provided at the corners of generally rectangular passageways in the grid through which the articles drop downwardly into the case. Each case may be moved into the load station by means of a conventional conveyor and lift table means is preferably provided to lift the upwardly open packing case into mating contact with the funnel subassembly so as to assure that the articles drop into the case partitions properly. Means is provided for decelerating the downwardly dropping articles, and cooperates with means for absorbing the impact of the articles as they strike the bottom of the case on the lift table itself.

Shifting grid case packers of this general type are generally used to pack articles of uniform size and shape, as for example bottles or glass containers. The load or charge is dropped into upwardly open cases or cartons which may include compartments or cells to receive the individual articles. The charge or slug of articles to be loaded is fed from an infeed conveyor across a deadplate into the upper portion of the grid structure itself, and the grid assembly is movably mounted on longitudinally extending ways such that the charge can be shifted downstream slightly in spite of line pressure of the oncoming articles on the infeed conveyor. A conventional line brake or similar hold-back system is preferably provided. The grid assembly further includes a shifting grid frame, which frame includes riding strips to support the articles in the upper portion of the grid assembly when in one position, and to allow the articles to drop downwardly when the strips are shifted to a second position. A funnel assembly is supported below the shifting grid and preferably comprises finger clusters arranged at the corners of the generally square passageways or openings through which the bottles move as they descend into the packing case. The packing case is fed to the load station on a horizontally extending conveyor and a lift table may be provided to mate the packing case with the funnel assembly, or finger clusters, to guide the articles as they drop into the case. Alternatively means may be provided for achieving a downward motion for the funnel assembly itself either in association with the grid assembly or as a separate step in the packing operation so as to achieve this mating of the funnel fingers and the case. In the latter situation a lift table would not be required, and the upwardly open case might instead be stopped briefly or at least matched to the speed of the funnel subassembly so that mating can be achieved between the funnel and the case to so guide the downwardly dropping articles.

The primary object of the present invention is to provide a novel means for decelerating the downwardly moving articles as they descend into the case and to provide impact absorbing means in association with the lift table or other load station defining structure that supports the upwardly open case being so loaded.

SUMMARY OF INVENTION

The foregoing advantages achieved in a case packer of the present invention by providing in the environment of an otherwise conventional drop packer of the shifting grid type, means for conveying cases to a load station immediately below the grid, and providing at the load station a resilient platform means to support the case so that dropping the articles into the case causes the resilient platform means to be displaced slightly and to thereby actuate a dash pot or damping means of the type adapted to exert a restoring force to the platform proportionately related to the downward speed of movement of the load of articles being dropped into the case. In further accordance with the present invention the grid structure provided above the load station includes lane defining means to receive articles in side-by-side columns and to form arrays of articles for drop packing. Shifting grid support means is provided for the articles being so formed in the grid, and means is provided to shift the article support means so that the articles are free to drop downwardly into the case. In order to impede the descent of the articles so dropped from the grid structure individual article following control arms are provided for movement between first positions adjacent to the riding strips and second positions out of the downward path of movement of the articles. The grid structure includes conventional pocket defining finger clusters that guide the articles dropped into the case being loaded, and the article following control arms are adapted to move between adjacent finger clusters to engage the bottoms of the articles so dropped and thereby impede there descent downwardly into the packing case.

CROSS REFERENCE TO RELATED APPLICATIONS

The following pending patent applications are incorporated by reference herein for purposes of supplementing the present disclosure:

FINGER ASSEMBLY FOR A CASE LOADER, Ser. No. 182,103, Filed Aug. 28, 1980, now abandoned SHIFTING GRID STYLE PACKER WITH LANE HOLDBACK, Ser. No. 269,389, Filed June 1, 1981, now U.S. Pat. No. 4,432,189

CONTINUOUS MOTION PACKER, Ser. No. 425,104, Filed Sept. 27, 1982, now U.S. Pat. No. 4,457,121

DESCENDING GRID FOR CASE PACKER, Ser. No. 502,739, Filed June 9, 1983

These pending applications, all assigned to the assignee herein, describe details of various shifting grid structures any one of which can be adapted for use in achieving the advantages of the present invention.

BRIEF DESCRIPTION OF THE DRAWINGS

FIG. 2 also shows the case conveyor for providing cases to the load station beneath the grid structure, together with a lift table for raising each case and mating the case with the funnel portion of the grid. The lift table is shown in the raised position shown, and is movable to a down position that permits the case to be moved downstream so that a succeeding case can be moved onto the lift table.

DETAILED DESCRIPTION

Figure 1:
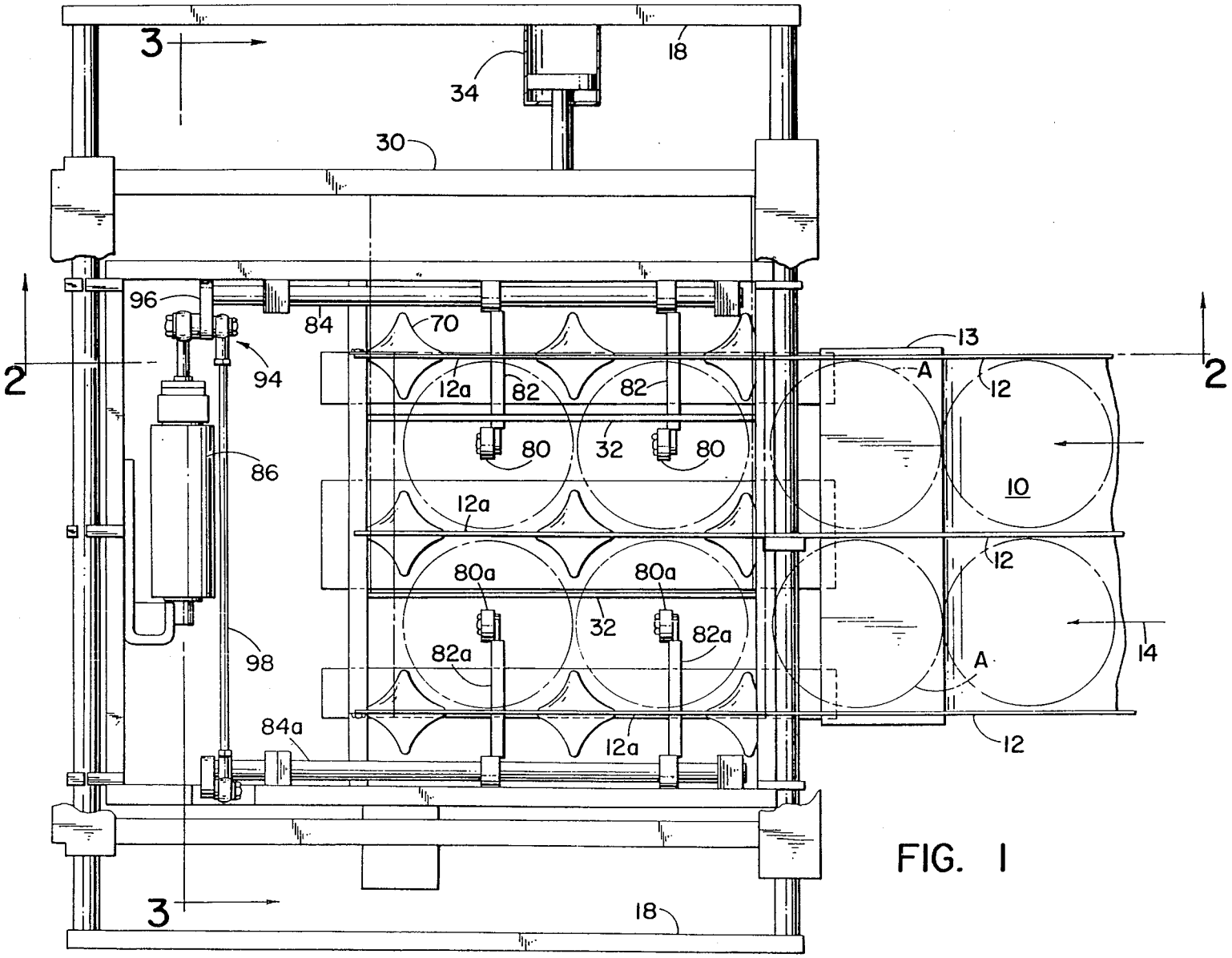
FIG. 1 is a plan view illustrating the infeed conveyor which moves the articles along riding strips that are adapted to shift laterally to provide a passageway for each article to drop downwardly through a funnel subassembly. Portions of the grid structure have been omitted for clarity, and other portions indicated in schematic fashion to better reveal the elements of the present invention.

Turning now to the drawings in greater detail, FIG. 1 shows a continuously operated article infeed conveyor 10 the downstream end of which conveyor is located in closely spaced relationship to the shifting grid type case packer to be described so that columns of articles of uniform shape and size A, A are adapted to be fed in the downstream direction, indicated by arrow 14, between fixed lane guides 12, 12 supported from the fixed frame of the packer (not shown). The articles A, A are shown in broken lines in FIG. 1. Only two lanes for the articles are shown in the presently preferred embodiment, but it will be apparent that any number may be provided between an appropriate number of lane guides in achieving certain advantages to the present invention.

A conventional shifting grid type drop packer forms the environment for the present invention and preferably comprises laterally spaced longitudinally extending frame legs 18, 18. These legs provide a fixed framework for supporting the grid assembly to be described. A longitudinally extending guideway (not shown) may be defined on each of these legs for slidably receiving the grid assembly so that the entire assembly is free to move slightly in the longitudinal direction all in conjunction with shifting movement of the grid frame itself to be described. A fluid actuator 34 is preferably provided between one leg 18 and a grid frame 30 for movement of the latter from the position shown, where riding strips 32, 32 are adapted to support articles A, A fed from right to left into the grid structure itself. Fluid actuator 34 serves to retract these riding strips 32, 32 into alignment with the fixed lane guides 12, 12 so that the articles A, A can be dropped downwardly between these riding strips and through the grid structure in a manner to be described.

Figure 2:
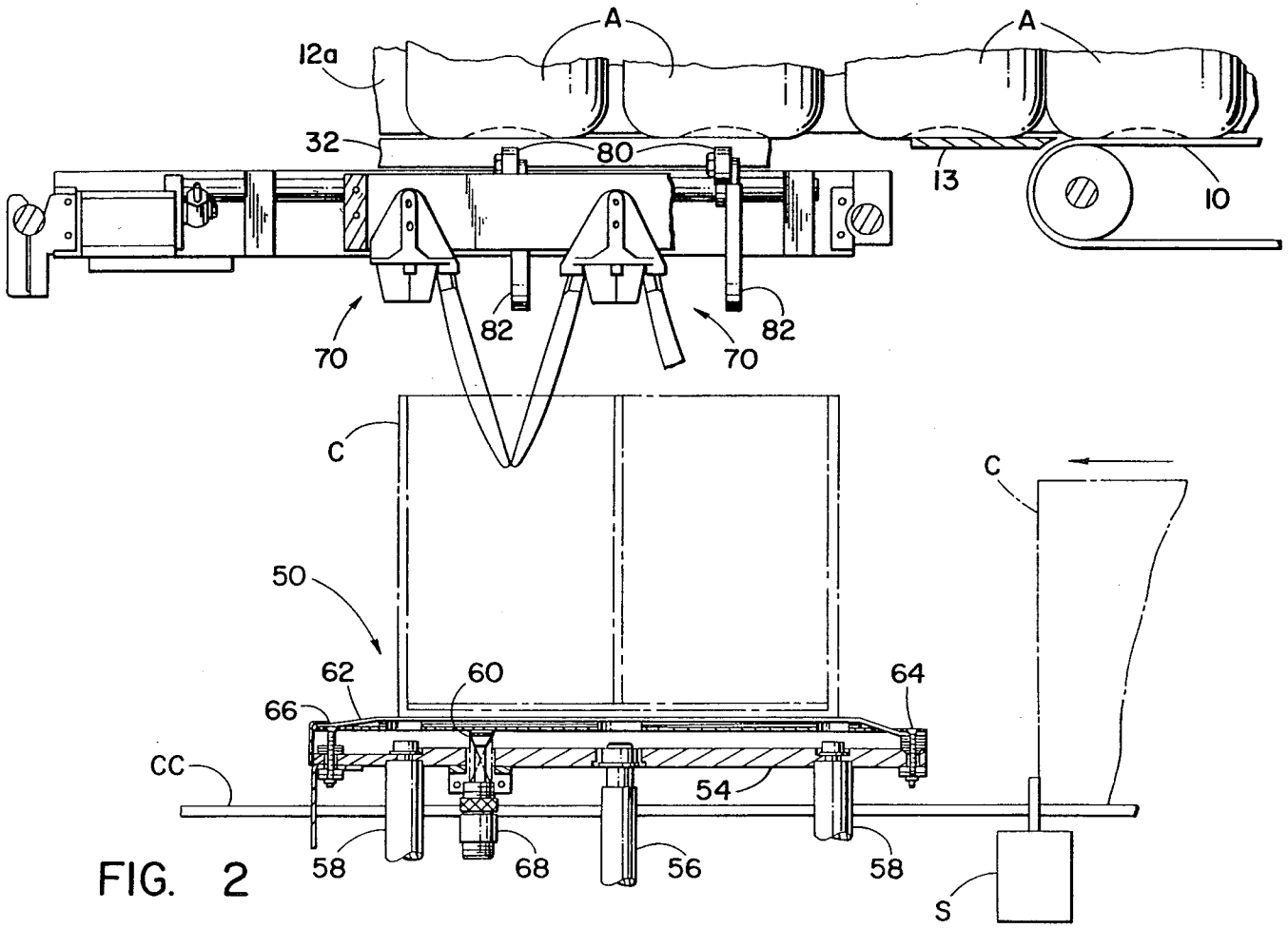
FIG. 2 is a vertical elevational view taken generally on the line 2—2 of FIG. 1. Again with portions broken away to reveal the elements of the present invention more specifically in the grid structure environment.

Still with reference to the grid assembly depicted in FIGS. 1 and 2, a conventional line brake assembly (not shown) is adapted to clamp one or more articles against a fixed deadplate 13 so that the group of articles provided in the grid can be shifted downstream and thereby provide a clearance between them and the articles held back by the clamping means. This conventional sequence facilitates dropping of the charge of articles through the grid downwardly into the packing case C. As described in one or more of the above mentioned pending applications the transverse shifting movement of the grid frame 30 may also be utilized to achieve this downstream shifting movement for the articles in the grid as for example by camming means or the like (not shown). Further, lane detectors (not shown) are preferably provided to generate a signal to indicate when the shifting grid is full. One such lane detector is represented by limit switch LS1 in FIG. 5. Obviously, several such lane detectors may be required to indicate that all of the various lanes in the grid structure have been properly filled. The riding strips 32, 32 are mounted on a subassembly such as that suggested in the prior art patents incorporated by reference herein, which subassembly itself comprises a rectangular frame that is readily removable for replacement or repair from the overall grid structure itself. See Ser. No. 298,061, now U.S. Pat. No. 4,406,111, for a more complete description of this aspect of the preferred embodiment for the present invention.

Figure 3:
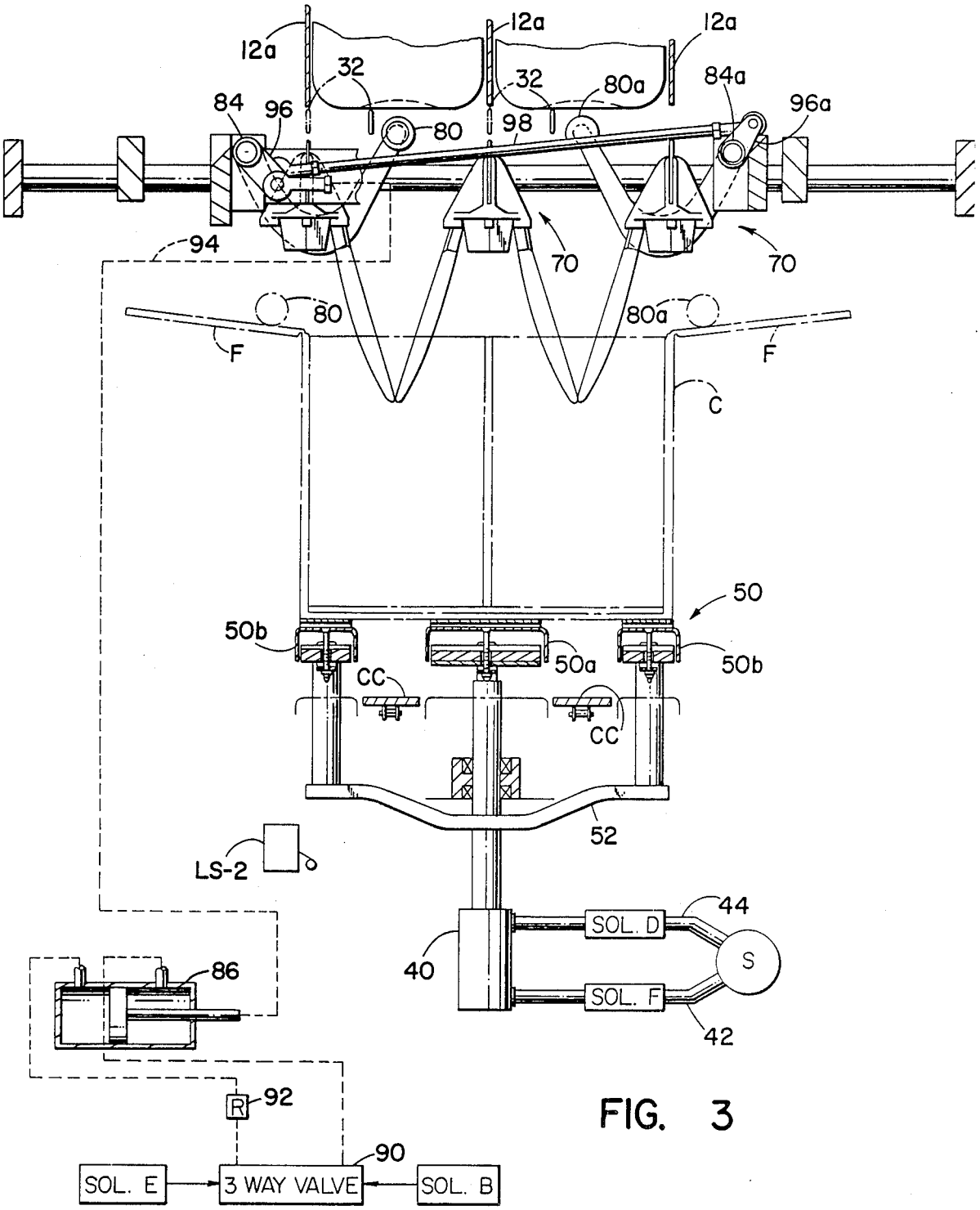
FIG. 3 is a vertical sectional view showing the grid structure and lift table of FIG. 2 and is taken generally on the line 3—3 of FIG. 1. Means for moving the article decelerating arms is shown schematically in this view.

The funnel subassembly for the grid structure shown in FIGS. 1, 2 and 3 preferably comprises a series of finger clusters mounted to longitudinally extending rails in the manner disclosed in some detail in the above-identified pending application Ser. No. 182,103 entitled "Finger Assembly For A Case Loader". These finger clusters 70, 70 each comprise a holder and retainer together with a suitable number of downwardly and inwardly directed fingers, which fingers are yieldably urged toward the center of the generally rectangular or square passageway through which each of the articles A, A decends from the grid into the upwardly open packing case C. As suggested in FIGS. 2 and 3 the packing case is preferably mated with the lower end portions of these fingers and in the embodiment shown this mating is achieved by lifting the packing case C off its case conveyor CC by a lift table 50 as best shown in FIG. 3. A vertically oriented fluid actuator 40 is provided, alternatively, with hydraulic fluid from lines 42 and 44 selectively connected to a source of fluid pressures and controlled by solenoid valves identified in FIG. 3 by reference letters D and F. Thus, when case conveyor CC provides a packing case in position at the load station, and when other conditions are met lift table 50 is moved from the phanthom line position shown in FIG. 3 to that shown in solid lines. The upper end of the case is mated with the lower ends of the various fingers of the funnel portion of the grid structure.

Figure 2A:
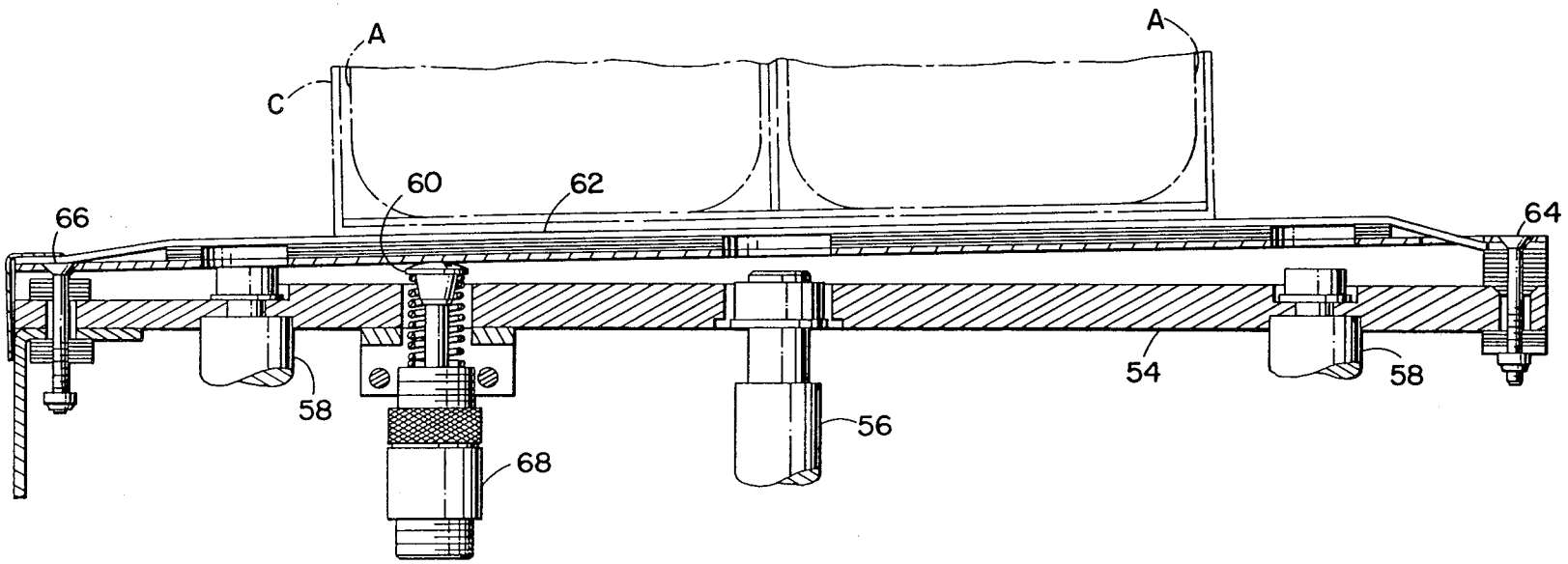
FIG. 2A is a view of the lift table portion of the apparatus illustrated in FIG. 2, and shows the resilient deformation of the lift table platform resulting from a load dropped thereon.

FIG. 3 also shows the case conveyor CC as being defined at the load station by laterally spaced segments between which segements, a center portion of the lift table 50*a* is provided. Laterally spaced outer portions 50*b* and 50*b* of the lift table are provided outside the case conveyor segments CC. The lift table portions 50*a* and 50*b* move together through a yoke structure 52. As best shown in FIGS. 2 and 2A the lift table is of generally conventional construction except for the case supporting platform portion thereof, which portion is also defined in three separate segments and only one of which is shown in FIGS. 2 and 2A. Each such platform segment includes a longitudinally extending frame portion 54 supported at the center by a center post 56 and at adjacent ends by longitudinally spaced posts 58, 58. Frame member 54 also defines an opening to receive an upwardly projecting plunger 60. Plunger 60 is adapted to engage the underside of a case engaging slide plate 62. Slide plate 62 is secured, at the upstream end, by fasteners 64 to the base or frame 54, and the downstream end is held in place by a fastener 66 designed to permit vertical motion of at least one end of the slide plate 62 relative to the base portion 54 except insofar as such motion is restricted by the shock absorbing fluid dampening device 68 having its plunger end 60 projecting through the base 54 of the lift table platform and abutting the underside of the slide plate 62.

As so constructed and arranged, the cases C are interrupted in their forward progress along the case conveyor CC by a retractable stop device S. Case C is located at the proper position on case conveyor C, C by a similar stop (not shown) so that this case C can be raised from a position on the case conveyor CC to the raised position shown in FIGS. 2 and 3 by the lift table 50 and its associated control circuitry. As the load of articles A, A drop downwardly through the grid into contact with the bottom wall of the case C resilient platform plate 62 will deform downwardly against the restoring force exerted by the plunger 60 of dampening device 68 and any shock or impact from the articles A, A will be absorbed and be turned into heat within the shock absorbing unit 68. The fluid filled shock absorbing unit 68 need not be described in detail as this item comprises a commerically available unit.

Figure 4:
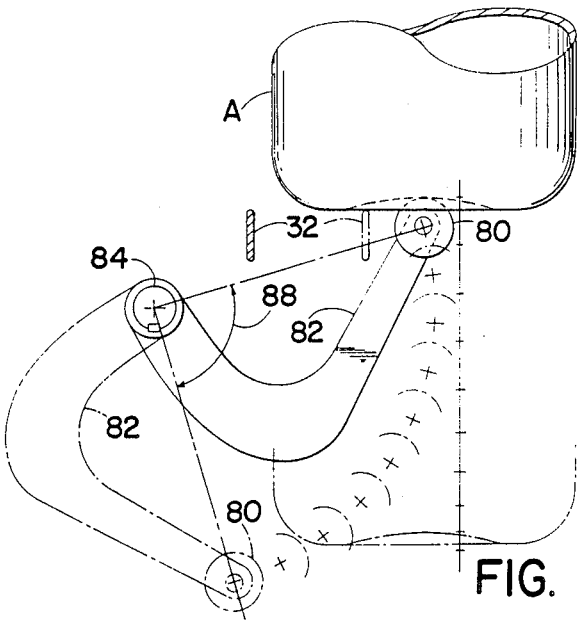
FIG. 4 is a schematic view to illustrate the motion of one of the control arms which serves to decelerate the downwardly moving article or bottle in each of the generally rectangular pockets provided in the grid structure itself. Limit positions for arm are shown in solid and phantom lines respectively.

Turning next to a more complete description of the means for decelerating the articles A, A as they drop downwardly through the grid. Prior to engagement with the bottom wall of the case C the articles are decelerated by arms 82, 82. FIG. 4 shows one article A in engagement with a follower roller 80 provided on control arm, or bellcrank 82. The article A is supported in this position by the bellcrank 82 because riding strip 32 will have been retracted from the broken line to the solid line position shown in this view permitting the article A to drop downwardly through the grid structure but for the action of roller 80. FIG. 4 shows schematically the path of motion for the control arm 82 and its associated roller 80 and it will be apparent that this arm rotates on the axis of a longitudinally extending rock shaft 84. As shown in FIG. 1 a fluid actuator 86 rotates rock shaft 84 through the angular displacement represented by reference numeral 88 in FIG. 4 in response to energizing of solenoid B in FIG. 5. That is, as the riding strips 32, 32 shift to the open position shown and limit switch LS3 is thereby closed energizing solenoid B and providing fluid pressure to the actuator 86. FIG. 3 shows this fluid circuit in schematic fashion. Fluid from a source of pressure S is provided through a three-way valve 90 through a flow restriction device 92 which is preferably adjustable so that the actuator 86 will impart a predetermined velocity of motion through linkage 94 to cause a desired angular speed of rotation for the rock shaft 84. Still with reference to FIG. 3 it will be apparent that the movable portion of fluid motor 86 is connected to a crank arm 96 on rock shaft 84 in order to achieve the angular displacement 88 desired in response to a full stroke for the actuator 86. A cross link 98 is provided between crank arm **96*a* on the other rock shaft 84*a* to achieve opposite rotational movement for the parallel rock shaft 84*a* in order to provide controlled movement for the control arms 82*a*, 82*a* associated with this second rock shaft 84*a***.

From FIG. 1 it will be apparent that the number of control arms is directly related to the number of articles A, A to be dropped through the grid and through the predetermined number of generally rectangular passageways defined in the grid. This deceleration for the dropped articles does not interfere with the depending fingers associated with the finger clusters 70 of the grid itself. As so constructed and arrranged shifting of the grid 30 and more particularly the riding strips 32, 32 causes the articles A, A to move downwardly into contact with each of the rollers 80 and **80*a* with the result that the articles are allowed to move downwardly under the influence of gravity and as restrained by the speed of movement for the control arms 82 and 82*a* as dictated by the setting in adjustable flow restrictor R indicated generally at 92 in FIG. 3. As the rollers 80 and 80*a* move out of the path of the downwardly moving articles A, A the articles continue to be guided by the depending fingers in each of the finger clusters 70** so as to enter the cells as defined by the partitions in the case C.

Figure 5:
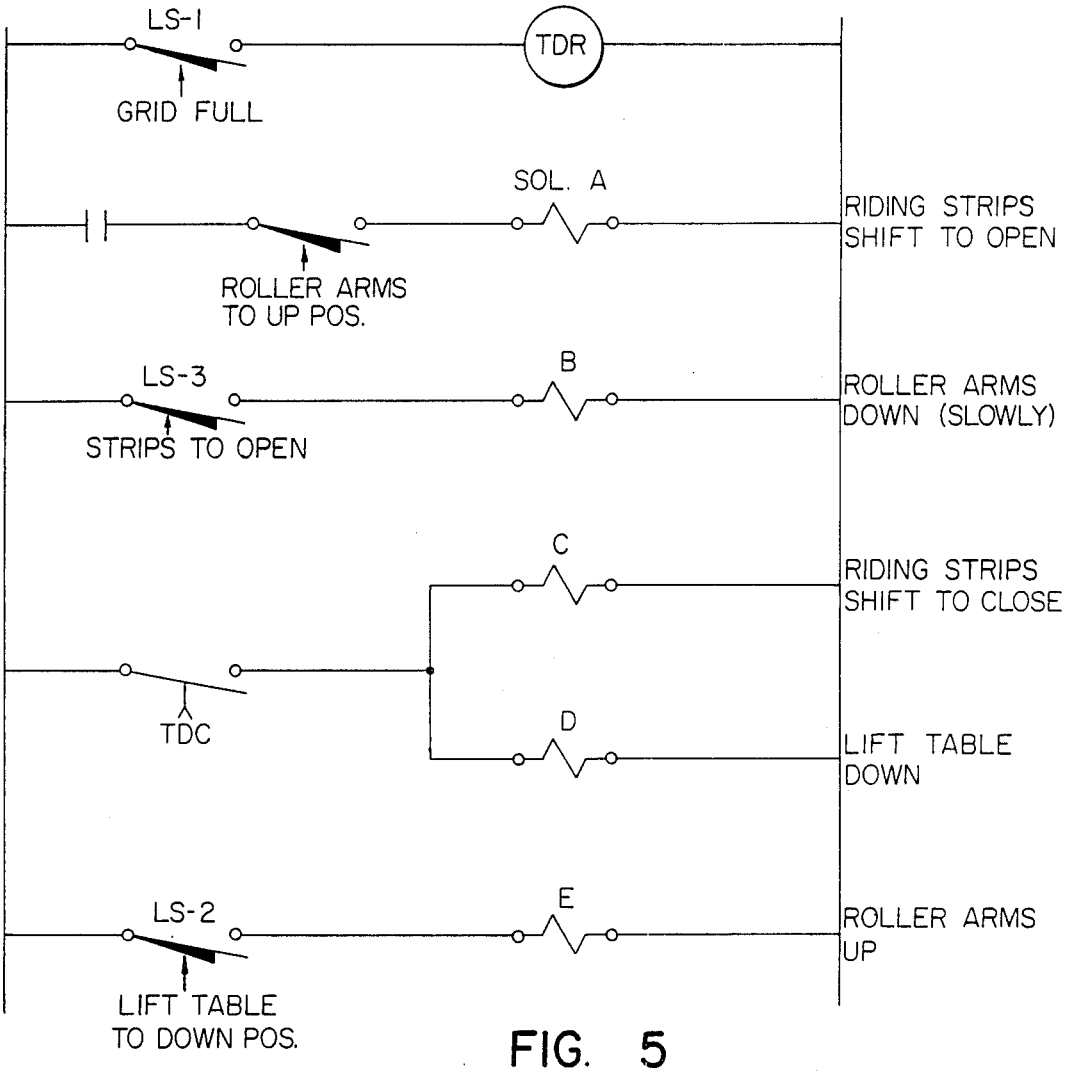
FIG. 5 is an electrical schematic to illustrate the sequence of operation for the various moving parts in the grid structure as related to the elements of the present invention.

The rollers 80 and **80*a* follow paths of motion that takes each of them initially downwardly along the path of movement of the articles, and then laterally outwardly out of the path of movement of the articles, with the result that these rollers can also serve to move the carton flaps F, F outwardly and out of the way of the decending charge of articles entering the case. This is shown to best advantage in FIG. 3 wherein the case flaps are shown in engagement with the rollers 80, 80 in the broken line positions for the latter. The roller arms are returned to their up position by action of solenoid E, and solenoid E is controlled by the position for a limit switch LS2 associated with the lift table. As the lift table moves to its down position limit switch LS2 is closed energizing solenoid E and causing control arms 82 and 82*a* to return to their up position indicated in solid lines in FIGS. 1, 2 and 3. Solenoid B will have been deenergized as a result of the riding strips 32 leaving their open positions and returning to their closed positions, all under the control of a relay TDR having time delayed closing contacts TDC associated with solenoid C as indicated in FIG. 5**.

I claim:

1. A case packer of the type adopted to form arrays of articles and to drop these article arrays into upwardly open packing cases, said packer comprising (a) means for conveying cases to a load station, and said load station including resilient platform means for so supporting the case that dropping the articles into the case causes said resilient platform means to provide displacement of said platform means, (b) grid structure above the load station and including lane defining means to receive articles in side-by-side columns and form the arrays, support means for the articles, and means to shift said article support means so that the articles are free to drop downwardly into a case, (c) means for impeding the descent of the articles so dropped from said grid structure, (d) said grid structure including individual article pocket defining finger clusters depending downwardly into the case so located at said load station, and (e) said article impeding means comprising individual article following control arms associated with at least some of said pockets and movable between adjacent finger clusters to engage the bottoms of the articles so dropped and impede their descent downwardly toward the packing case, said load station including a base structure for movably supporting said platform, and means acting between said base and said platform to provide a resilient biasing force acting upwardly to urge said platform toward a position to receive articles dropped into a case so located at said load station, said means so acting between said base and said platform providing a resilient restoring force that is related to the downward motion of said platform to absorb the impact of articles dropped into a case, means for so moving said control arms includes longitudinally extending rock shafts defining said parallel axes, and fluid motor means coupled to said shafts to rotate them in sequential relationship to the movement of said article support means into said second positions.

2. The case packer of claim 1 wherein said means for moving said arms further includes a fluid circuit that comprises said fluid motor means, and said circuit also comprising a fluid flow restrictor to reduce the speed of movement of said fluid motor means in at least one direction.

3. The case packer of claim 2 further characterized by means for conveying upwardly open cases into said load station generally below said grid structure, said loading station including a resilient platform that is deformable downwardly when articles are dropped into a case so located, said platform having a base and a vertically displaceable platform movably mounted on said base, and means responsive to downward motion of said platform to exert a restoring force on said platform to absorb the impact of the articles dropped into the case.

4. In a case packer of the type adapted to receive arrays of articles and to drop these article arrays into a packing case at a load station the improvement comprising grid structure including longitudinally spaced finger clusters defining generally rectangular article pockets through which the articles drop in guided fashion into an upwardly open packing case provided below the grid structure, said grid structure having article support means for selectively preventing the articles from so dropping, means for moving said article support means from first positions where articles are so supported to second positions wherein the articles are free to drop, control arms having free end portions located between said finger clusters in the downward path of movement of articles so dropped, means for moving said free end portions from first positions initially downwardly and in the general direction of the articles so dropped and then for moving said free end portions out of the downward path of movement of the articles, said means for so moving said free end portions of said control arms including means for varying the speed of downward movement for said control arm free end portions, said arms being rotatably supported on at least two parallel axes located alongside said load station, said arms having free end portion movable pivotably between said finger clusters from first positions adjacent said article support means when the latter occupy said first positions generally arcuately and downwardly between said finger clusters to second positions out of the downward path of movement of the articles, and said means for so moving said control arms including longitudinally extending rock shafts defining said parallel axes and fluid motor means coupled to said shafts to rotate them in sequential relationship to the movement of said article support means into said second positions.

5. The case packer of claim 4 wherein said means for moving said arms includes a fluid circuit that comprises said fluid motor means, and said circuit also comprising an adjustable fluid flow restrictor to vary the speed of movement of said fluid motor in at least one direction.

* * * * *